US010314415B2

(12) United States Patent
Macdonald

(10) Patent No.: US 10,314,415 B2
(45) Date of Patent: Jun. 11, 2019

(54) BAG DISPENSER

(71) Applicant: Walmart Apollo, LLC, Bentonville, AR (US)

(72) Inventor: Linda Lee Macdonald, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 234 days.

(21) Appl. No.: 15/250,360

(22) Filed: Aug. 29, 2016

(65) Prior Publication Data

US 2017/0055726 A1 Mar. 2, 2017

Related U.S. Application Data

(60) Provisional application No. 62/212,314, filed on Aug. 31, 2015.

(51) Int. Cl.
*A47F 9/04* (2006.01)

(52) U.S. Cl.
CPC ..... *A47F 9/042* (2013.01); *A47F 2009/044* (2013.01)

(58) Field of Classification Search
CPC ..... A47F 9/042; A47F 9/043; A47F 9/044; Y10T 225/30; Y10T 225/307; Y10T 225/314; Y10T 225/321
See application file for complete search history.

(56) References Cited

U.S. PATENT DOCUMENTS 1,973,354 A * 9/1934 Nedberg ..... A47K 10/38 225/33
2,304,312 A * 12/1942 Meglitz ..... A47K 10/38 225/47
2,349,635 A * 5/1944 Pusheck ..... B65H 35/0006 225/77
3,158,304 A * 11/1964 Wooster ..... A47K 10/38 225/74
3,494,518 A * 2/1970 Goss ..... A47K 10/38 225/34
3,696,697 A * 10/1972 Hoffman ..... B23K 3/063 225/78
3,750,971 A * 8/1973 Chevas ..... A47K 10/3836 242/594.5
3,823,889 A 7/1974 Johnson et al.
4,205,802 A 6/1980 Economakis
(Continued)

*Primary Examiner* — Jason Daniel Prone
*Assistant Examiner* — Richard D Crosby, Jr.
(74) *Attorney, Agent, or Firm* — McCarter & English, LLP; David R. Burns

(57) ABSTRACT

Exemplary embodiments are related to a bag dispenser. The bag dispenser can include a support structure, a first arm, a second arm, and a pin. The support structure can have an elongated body. The first arm can be operatively coupled to, and can extending from, a first end of the support structure. The second arm can be operatively coupled to, and can extend from, a second end of the support structure. The pin can have a proximal end and a distal end. The proximal end of the pin can be secured to the first arm and can be configured to translate within a first bounded channel between a first opposing channel ends. The distal end of the pin is configured to be received by a second bounded channel and can be configured to translate within a second bounded channel between a second opposing channel ends.

16 Claims, 11 Drawing Sheets

(56) References Cited

U.S. PATENT DOCUMENTS 4,222,532 A * 9/1980 DeLuca ..... A47K 10/40 242/423
4,381,083 A 4/1983 Tsunetsugu
4,416,425 A * 11/1983 Kish ..... A47K 10/405 211/171
4,750,694 A * 6/1988 Bateman ..... B65B 67/1266 248/175
4,863,125 A * 9/1989 Bateman ..... B65B 67/1266 248/97
5,190,253 A * 3/1993 Sable ..... B65B 67/1205 248/97
5,556,019 A * 9/1996 Morris ..... B65D 33/002 225/106
5,558,262 A * 9/1996 Simhaee ..... B26F 3/002 225/106
5,573,168 A 11/1996 Kannankeril et al.
5,618,008 A * 4/1997 Dearwester ..... A47K 10/32 242/594.5
5,727,721 A * 3/1998 Guido ..... B26F 3/002 221/63
5,765,775 A * 6/1998 Keserica ..... A47K 10/38 242/597
5,810,234 A * 9/1998 Burli ..... A47F 9/042 225/106
5,813,585 A * 9/1998 Kannankeril ..... A47F 9/042 225/106
5,913,491 A * 6/1999 Bulla ..... A47K 10/3836 242/597
5,934,535 A 8/1999 Kannankeril et al.
6,089,514 A * 7/2000 Huang ..... B65B 43/14 248/95
6,199,788 B1 3/2001 Simhaee
6,230,953 B1 5/2001 Simhaee
6,234,431 B1 * 5/2001 Simhaee ..... A47F 9/042 248/118
6,279,806 B1 * 8/2001 Simhaee ..... A47F 9/042 225/106
6,481,594 B1 11/2002 Yeh et al.
6,554,222 B1 * 4/2003 Lindow, Sr. ..... A47K 10/38 242/598.5
6,561,403 B1 5/2003 Kannankeril et al.
6,592,013 B1 * 7/2003 Fujiwara ..... A47K 10/38 225/39
6,604,660 B2 * 8/2003 Gochanour ..... B65H 35/06 128/879
6,685,075 B1 * 2/2004 Kannankeril ..... A47F 9/042 225/106
6,705,565 B1 * 3/2004 Newman ..... A47K 10/32 242/598.6
6,786,377 B1 * 9/2004 Holden ..... A47K 10/38 206/409
7,011,272 B2 * 3/2006 Faulks ..... A47K 10/32 242/598.6
7,124,674 B2 * 10/2006 Maxey ..... A47F 13/045 83/649
7,128,251 B1 * 10/2006 Galle ..... A47F 9/042 225/2
7,270,256 B2 9/2007 Daniels
7,424,963 B2 9/2008 Daniels
7,500,420 B2 * 3/2009 Cvjetkovic ..... A47K 10/38 225/106
7,552,842 B1 * 6/2009 Carvajal ..... B26D 1/045 221/30
7,591,405 B2 9/2009 Daniels
7,677,507 B1 * 3/2010 Rothbauer ..... B65B 67/12 248/100
7,762,493 B2 * 7/2010 Berberet ..... A47K 10/405 242/598.2
7,861,904 B1 * 1/2011 Taylor ..... B65H 35/0026 225/65
8,251,270 B2 8/2012 Tseng
8,393,509 B2 * 3/2013 Greg ..... B65H 35/00 221/34
8,875,968 B2 * 11/2014 Tan ..... B65H 35/10 225/10
8,905,283 B2 * 12/2014 Tan ..... B65H 35/10 225/106
9,096,408 B2 * 8/2015 Tan ..... B65H 35/10
9,199,820 B2 * 12/2015 Tseng ..... B65H 35/10
9,415,886 B2 * 8/2016 Sill ..... B65B 5/045
9,648,994 B2 * 5/2017 Cattacin ..... A47K 10/38
9,844,283 B2 * 12/2017 Bacallao ..... A47F 9/042
9,890,009 B1 * 2/2018 Chen ..... B26F 3/02
10,028,597 B2 * 7/2018 Bacallao ..... A47F 9/042
2002/0079344 A1 * 6/2002 Pitzen ..... B65H 35/002 225/20
2003/0098326 A1 * 5/2003 Wile ..... A47F 9/042 225/77
2004/0222263 A1 * 11/2004 Holden ..... A47K 10/3836 225/106
2007/0210131 A1 * 9/2007 Yarborough ..... B65H 49/205 225/56
2011/0073629 A1 * 3/2011 Tseng ..... B26F 3/02 225/51
2012/0024884 A1 2/2012 Wilfong
2012/0125970 A1 * 5/2012 Tsui ..... A47F 13/085 225/106
2012/0305619 A1 * 12/2012 Tan ..... B26F 3/02 225/106
2013/0134181 A1 * 5/2013 Helseth ..... B65H 16/005 221/26
2014/0048576 A1 2/2014 Tan
2014/0144966 A1 * 5/2014 Tan ..... B26F 3/02 225/47
2017/0055726 A1 * 3/2017 Macdonald ..... A47F 9/042

* cited by examiner

BAG DISPENSER

CROSS-REFERENCE TO RELATED PATENT APPLICATIONS

This application is claims priority to U.S. Provisional Application No. 62/212,314 filed on Aug. 31, 2015, the content of each application is hereby incorporated by reference in its entirety.

BACKGROUND

It is common for grocery stores and supermarkets to have bag dispensers for dispensing bags from rolls of bags. Conventional bag dispenser have historically been designed to limit the types of rolls of bags that can be mounted on them. Additionally, conventional bag dispensers can be unsafe, often allowing the entire roll of bags to be unintentionally removed. For example, in some instances, when a customer pulls a bag from the roll of bags, the roll of bags may be released from the bag dispenser, which can lead to customer injury.

BRIEF DESCRIPTION OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features.

The foregoing and other features and advantages provided by the present disclosure will be more fully understood from the following description of exemplary embodiments when read together with the accompanying drawings.

DETAILED DESCRIPTION

Exemplary embodiments of the present disclosure are related to a universal bag dispenser configured to dispense bags from different types of rolls of bags that can be sourced from different manufacturers. Exemplary embodiments of the bag dispenser can also overcome the safety concerns associated with conventional bag dispensers. The bag dispenser can include a support structure, a first arm, a second arm, and a pin. The support structure can have an elongated body extending between a first end and a second end. The first arm can be operatively coupled to, and can extend from, the first end of the support structure. In exemplary embodiments, the first arm can include a first bounded channel extending along a length of the first arm. The pin can have a proximal end and a distal end, and can extend through the first bounded channel. The proximal end of the pin can be secured to the first arm and can be configured to move or travel within the first bounded channel between the first opposing channel ends, where the first opposing channel ends prevent removal of the pin from the first bounded channel. The second arm can be operatively coupled to, and can extend from, the second end of the support structure. The second arm can include a second bounded channel that extends along a length of the second arm between second opposing channel ends.

In exemplary embodiment, the second arm can be configured to rotate with respect to the support structure and/or the first arm. For example, the second arm can rotate between a first position in which the second arm is perpendicular to the first arm and a second position in which the second arm is parallel to and opposingly spaced from the first arm. The distal end of the pin can be received by and/or extend through the second bounded channel of the second arm when the second arm is in the second position. When the second arm is in the first position, a roll of bags can be mounted on the pin, and when the second arm is in the second position, the roll of bags can be secured on the pin between the first and second arms.

Figure 1:
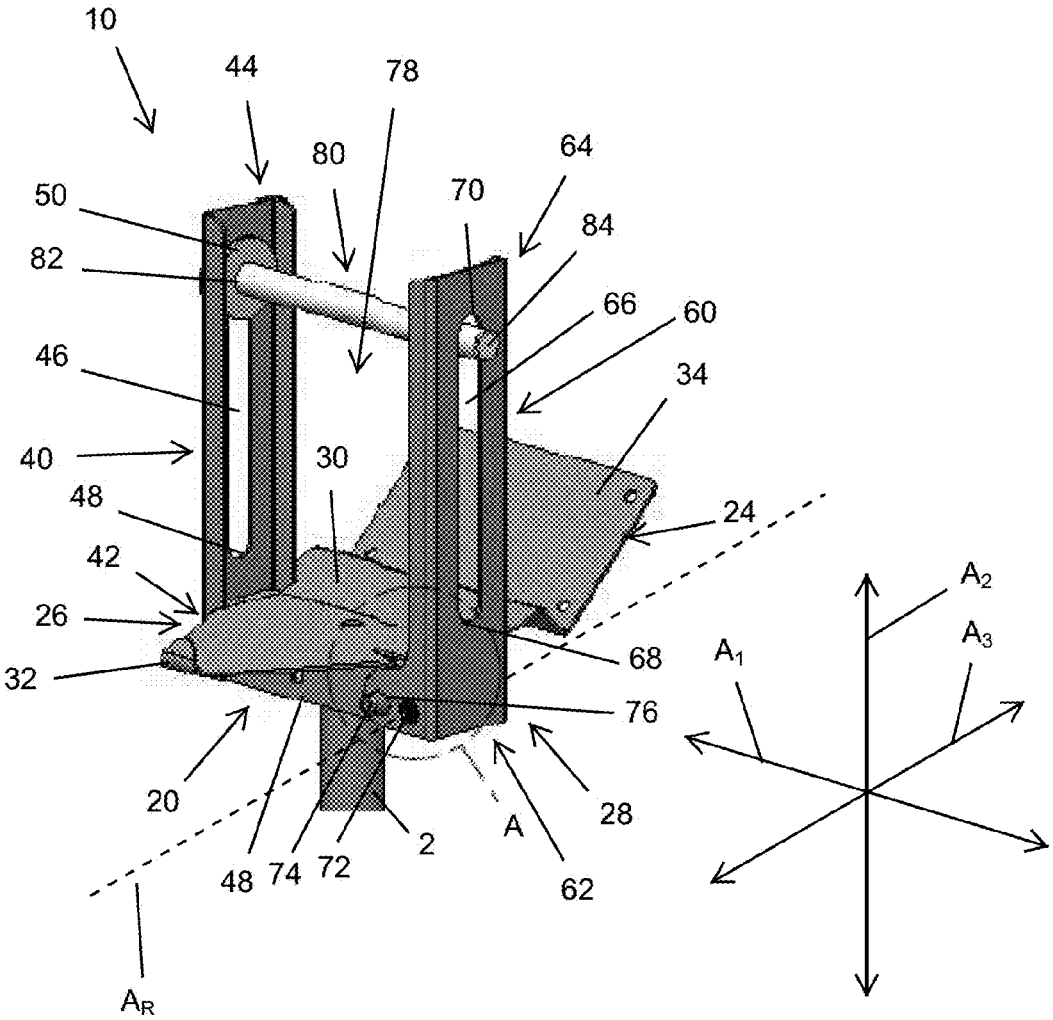
FIG. 1 is a front perspective view of a bag dispenser in accordance with embodiments of the present disclosure.
Figure 11:
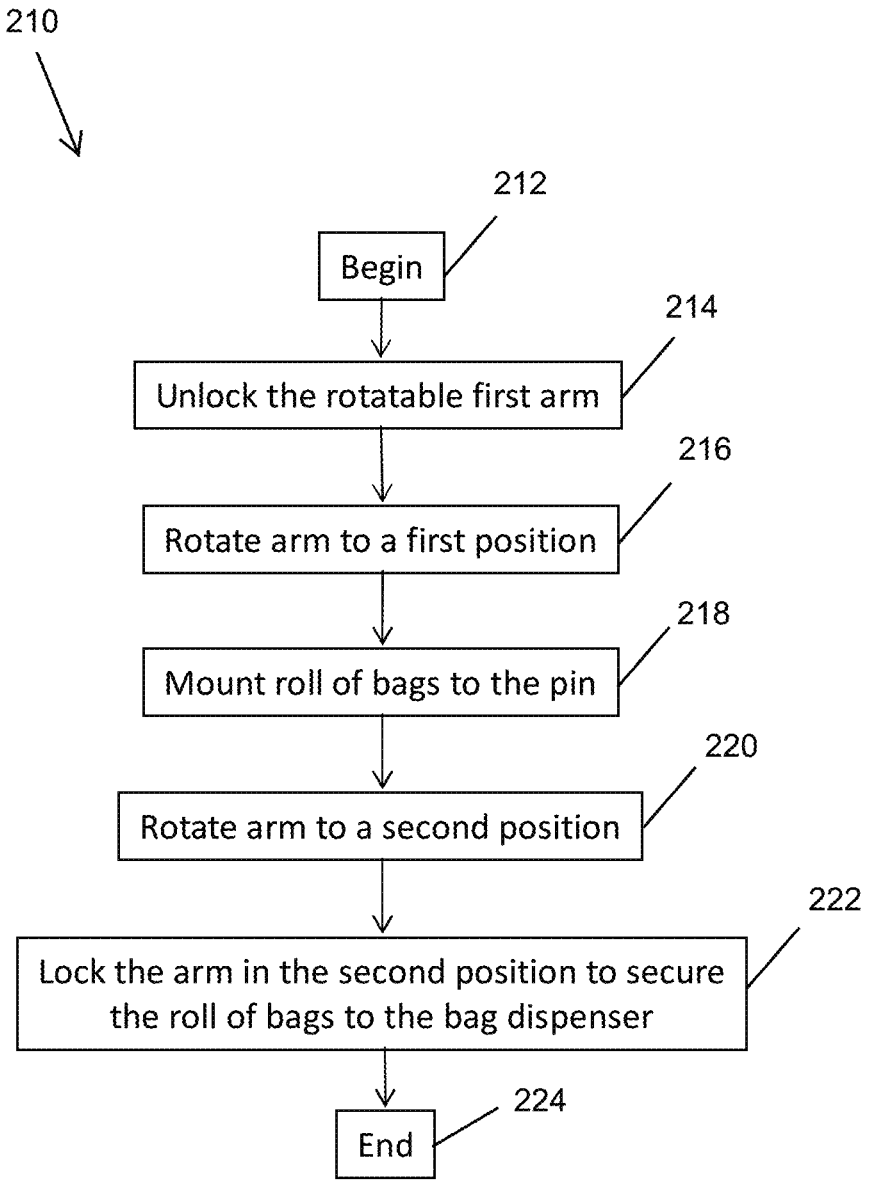
FIG. 11 is a flowchart illustrating an exemplary process for installing a roll of bags on a bag dispenser in accordance with embodiments of the present disclosure.

FIG. 1 is a front perspective view of a bag dispenser 10 in accordance with embodiments of the present disclosure. In exemplary embodiments, the bag dispenser 10 can be configured to hold and dispenser bags from a roll of bags. As shown in FIG. 1, the bag dispenser 10 can include a support structure 20, arms 40 and 60 extending from the support structure 20, and a pin 80. Exemplary embodiments of the bag dispenser 10 can be configured to mounted on a post 2 or to a wall (as shown in FIG. 11).

The support structure 20 has an elongated body member 22 and a base member 24. The elongate body member 22 and the base member 24 can be integrally formed, secured together via a fastener, a weld joint, and/or operatively coupled using any other suitable mechanism. In some embodiments, the base member 24 can be detachably secured to the elongated body member 22. A length of the elongated body member 22 extends along an axis $A_1$ between first end 26 and a second end 28. In exemplary embodiments, the elongated body member 22 can include a post mounting portion configured to receive the post 2 to mount the bag dispenser 10 on the post 2. The elongated body member 22 supports the base member 24, which includes a bag support portion 30, a hooked portion 32, and a wall-mounting portion 34. The bag support portion 30 provides an area upon which a portion of an outer surface of a roll of bags can rest. The bag support portion 30 can provide a friction force against the unrolling of the roll of bags when user pulls the next bag to be dispensed by the bag dispenser 10. The hooked portion 32 can be configured to separate individual bags in the roll of bags as the roll of bags in unrolled. The wall-mounting portion 34 can provide an area on the base member 24 that is configured to facilitate mounting of the bag dispenser 10 to a wall or a generally vertical support structure. In some embodiments, the bag support portion 30, the hooked portion 32, and the wall-mounting portion 34 can be at least partially angled with respect to each other, as described in more detail herein.

The arm 40 can have a length extending between an arm end 42 and an arm end 44, and can extend perpendicularly from the support structure 20 along an axis $A_2$ that is perpendicular to the axis $A_1$ (i.e. the length of the arm 40 can extend perpendicularly from the first end 26 of the elongated body member 22 along the axis A2). The arm 40 can include a bounded channel 46 formed therein, which can extend along a portion of the length of the first arm 40 between opposing channel ends 48 and 50. In exemplary embodiments, the arm end 42 of the arm 40 can be attached to, integrally form with, or otherwise operatively coupled to the first end 26 of the elongated body member 22, and the arm end 44 can form a terminal, free end of the arm 40. In some embodiments, an orientation of the arm 40 can be substantially fixed with respect to the elongated body member 22. In some embodiments, an orientation of the arm 40 can be adjustable with respect to the elongated body member 22 such that a position of the arm 40 can deviate from its perpendicular alignment with the elongated body member 22.

The arm 60 can have a length extending between an arm end 62 and an arm end 64, and can extend from the support structure 20. The arm 60 can include a bounded channel 66 formed therein, which can extend along a portion of the length of the arm 60 between opposing channel ends 68 and 70. In exemplary embodiments, the arm end 62 of the arm 60 can be operatively coupled to the second end 28 of the elongated body member 22, and the arm end 64 can form a terminal free end of the arm 60. For example, the arm end 62 of the arm 60 can be pivotally or rotatably attached to the second end 28 of the elongated body member 22 to form a joint 72 (e.g., a hinge) between the elongated body member 22 and the arm 60 to allow the arm 60 to rotate with respect to the support structure 20 and the arm 40.

Figure 2:
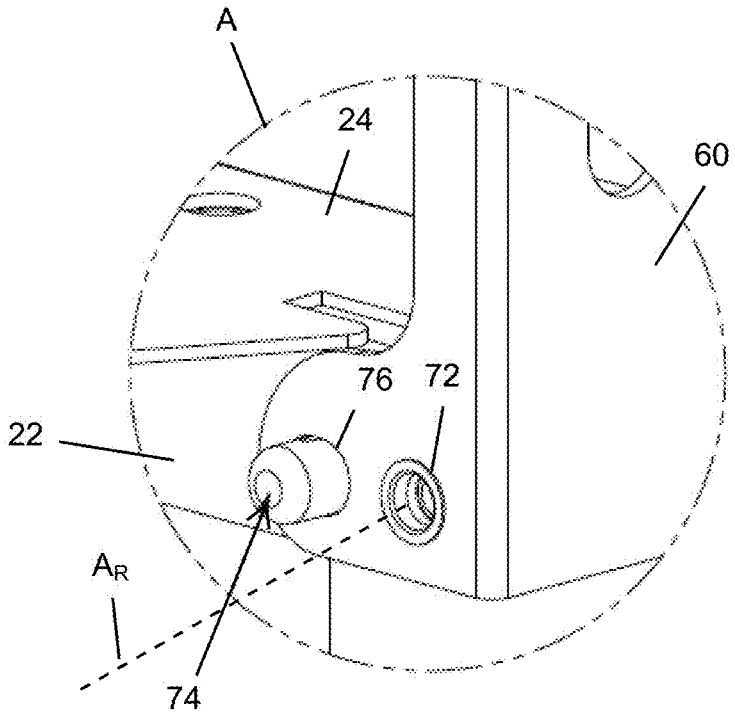
FIG. 2 illustrates a detailed view of a portion of the bag dispenser shown in FIG. 1.

Referring to FIGS. 1 and 2, the bag dispenser 10 can include a locking member 74 configured to selectively lock an orientation of the arm 60 with respect to elongated body member 22 and the arm 40 to prevent rotation of the arm 60. For example, as shown in FIG. 1, the locking member 74 can be configured to engage an aperture or opening 76 formed in the arm 60 at the arm end 62 to substantially fix an orientation and position of the arm 60 in a locked position such that the length of the arm 60 extends from the support structure 20 parallel to the axis $A_2$ and perpendicular to the axis $A_1$ by operation of a locking member 74 (i.e. the length of the arm 60 can be selectively fixed to extend perpendicularly from the second end 28 of the elongated body member 22 and parallel to the length of the arm 40). When the arm 60 is in the locked position, such that the arm 60 and the arm 40 extend from the elongated body member in parallel and in the same direction, the arms 40 and 60 can be opposingly spaced from one another defining a space or area 78 for retaining a roll of bags. In exemplary embodiments, the locking member 74 can be actuated to allow the arm 60 to rotate to unlocked positions with respect to axis $A_3$. For example, the arm 60 can rotate about an axis of rotation $A_R$ defined by the joint 72 formed between the elongated body member 22 and the arm 60, where the axis of rotation $A_R$ extends parallel to the axis $A_3$. In some embodiments, the axis $A_3$ and the axis of rotation $A_R$ can extend perpendicularly to the axis $A_1$ and the axis $A_2$.

As shown in FIG. 1, the pin 80 can have an elongated body extending between a proximal end 82 and a distal end 84. The pin 80 can be configured to receive a roll of bags such when a roll of bags is mounted on the pin 80, the roll of bags circumferentially surrounds the pin 80. In exemplary embodiments, the pin 80 can extend through the bounded channel 46 of the arm 40. The proximal end 82 of the pin 80 can be secured to the first arm 40 and can be configured to move or translate within the bounded channel 46 between the opposing channel ends 48 and 50. The proximal end 82 of the pin 80 can be operatively coupled to the arm 40 such that the opposing channel ends 48 and 50 prevent removal of the pin 80 from the bounded channel 46. In some embodiments, the pin 80 can be operatively coupled to the arm 40 in a manner that maintains an orientation of pin 80 as the pin 80 translates within the bounded channel 46. For example, in some embodiments, the proximal end 82 of pin 80 can be operatively coupled to the arm 40 such that the pin extends perpendicularly with respect to the axis $A_2$ and the axis of rotation $A_R$, and parallel to the axis $A_1$ (e.g., the pin 80 can extended perpendicularly from the arm 40 and parallel to the elongated body).

The distal end 84 of the pin 80 can engage and/or extend through the bounded channel 66 when the arm 60 is in the locked position (e.g., parallel to and extending in the same direction as the arm 40). The distal end 84 of the pin 80 can move or translate within the bounded channel 66 between the opposing channel ends 68 and 60 when the arm 60 is in the locked position (e.g., when the locking member engages the opening 76). When the arm 60 is in the locked position, the distal end 84 of the pin 80 can be retained by the bounded channel 66 such that the opposing channel ends 68 and 70 prevent removal of the pin 80 from the bounded channel 66. When the arm 60 is in an unlocked position (e.g., the locking member is disengaged from the opening 76) and rotated such that the arm 60 is no longer parallel to and extending in the same direction as the arm 40, the distal end 84 of the pin can be disengaged or removed from the bounded channel 66 of the arm 60.

The exemplary configuration of the bag dispenser 10, shown in FIG. 1, illustrates mounting the support structure 20 of bag dispenser on the post 2. When the bag dispenser 10 is mounted on the post 2, a length of the post 2 can extend in a direction that is generally parallel to the axis $A_2$ and perpendicular to the axis $A_1$. In the example configuration, the length of the post 2 can be perpendicular to the length of the elongated body 22 of support structure 20, and can be parallel to the length of the lengths of the arms 40 and 60 (when the arm 60 is in the locked position).

Figure 3:
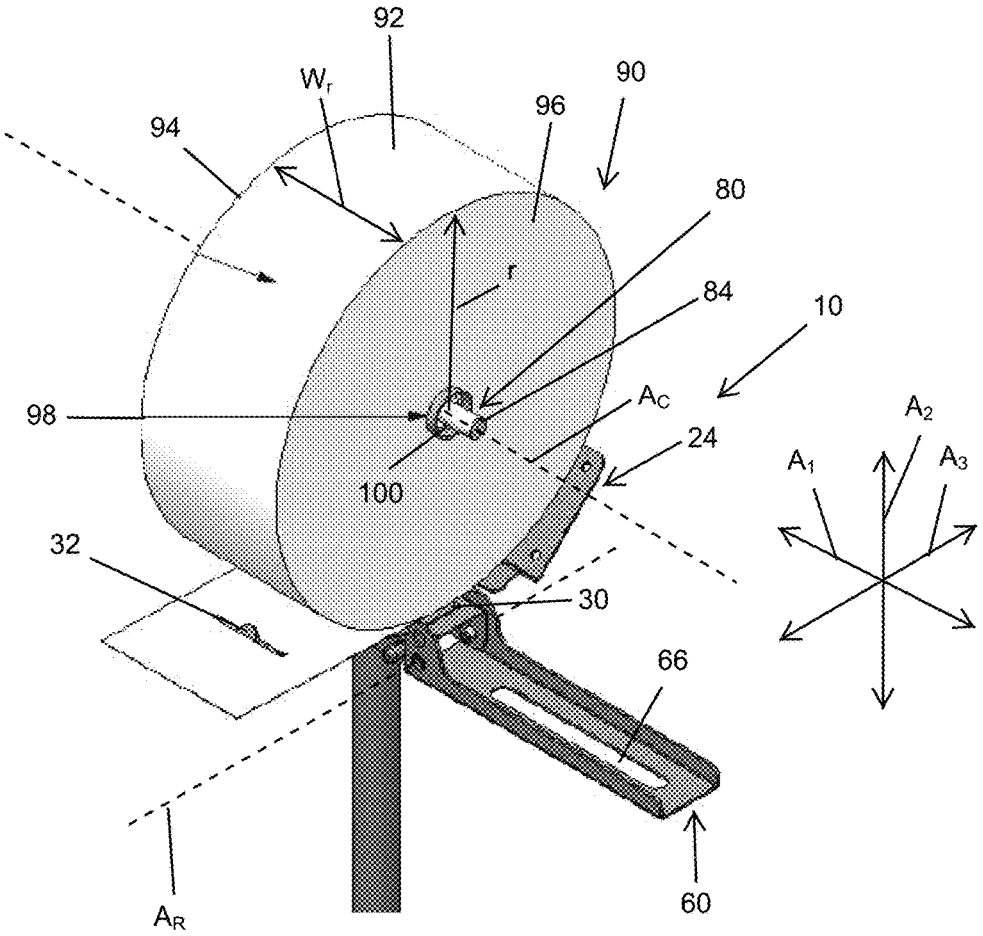
FIG. 3 illustrates an embodiment of the bag dispenser configured for installation of a roll of bags in accordance with embodiments of the present disclosure.
Figure 4:
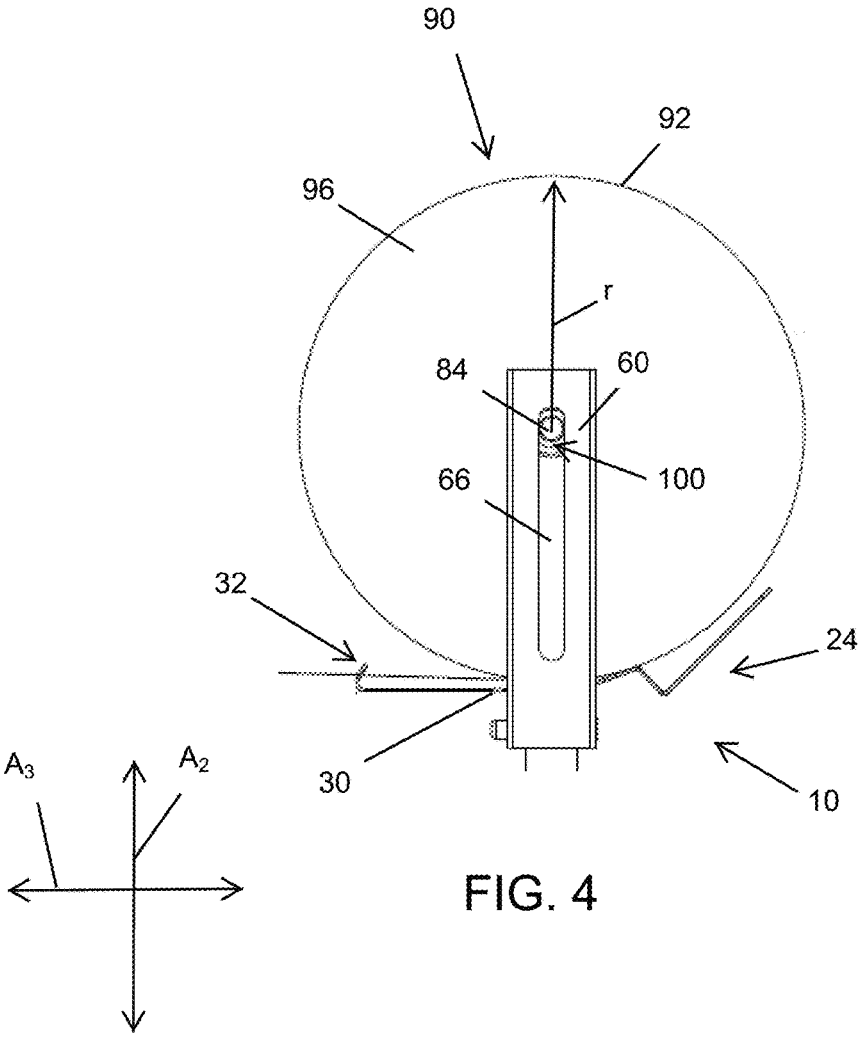
FIG. 4 illustrates a side view of an embodiment of the bag dispenser having a roll of bags installed thereon in accordance with embodiments of the present disclosure.
Figure 5:
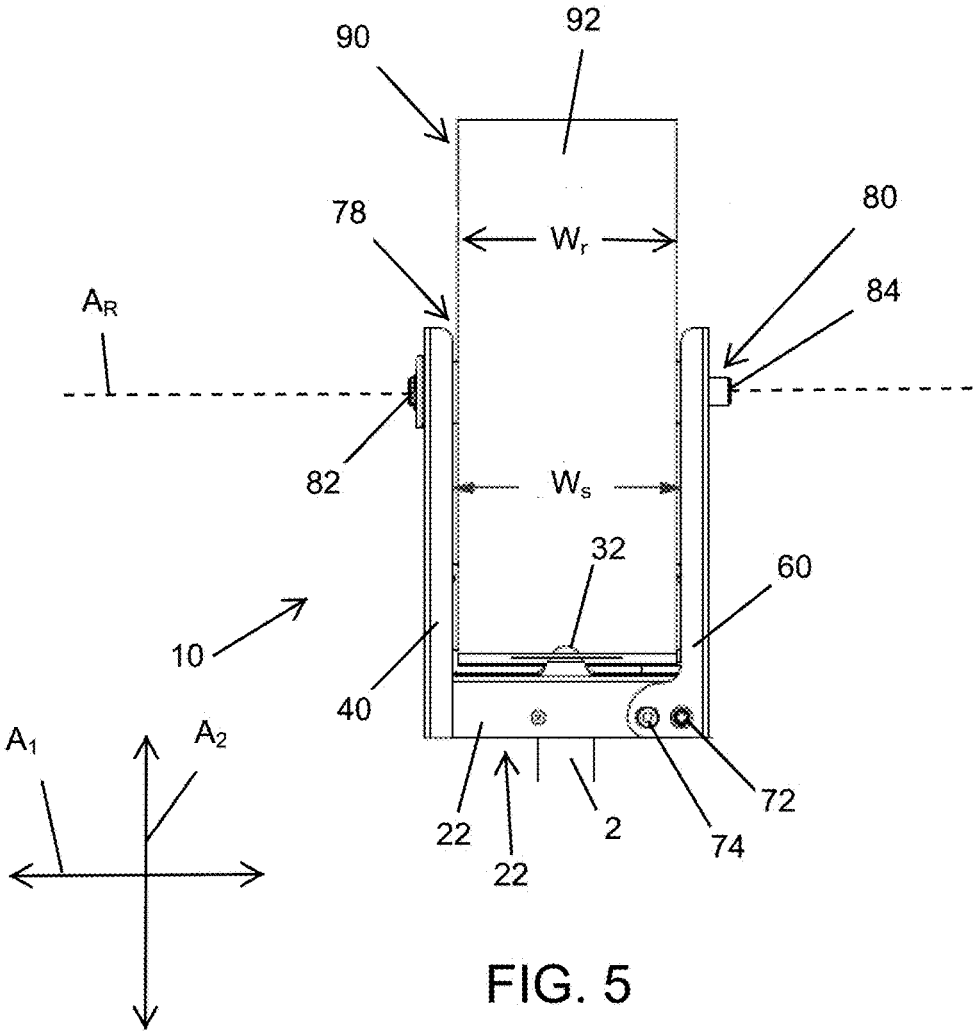
FIG. 5 illustrates a front view of an embodiment of the bag dispenser shown in FIG. 1 having a roll of bags installed thereon in accordance with embodiments of the present disclosure.

FIG. 3 illustrates an embodiment of the bag dispenser 10 with the arm 60 in an unlocked position to facilitate installation of a roll of bags 90 in accordance with embodiments of the present disclosure. As shown in FIG. 3, the arm 60 has been rotated approximately ninety degrees about the axis of rotation $A_R$ from the locked position shown in FIG. 1 to an unlocked position in which a length of the arm 60 extends parallel to the axis $A_1$ and perpendicular to the axis $A_2$ (e.g., parallel to the elongated body of the support structure and perpendicular to the arm 40). In this position, the distal end 84 of the pin 80 is a terminal, free end. While the unlocked position illustrated in FIG. 3 has a specific orientation, the arm 60 can be rotated to other orientations. For example, in some embodiments, the arm 60 can be rotated approximately one hundred eighty degrees such that the arm 60 is parallel to the arm 40, but the arm 60 extends in a different direction from the support structure than the arm 40. By moving the arm 60 to an unlocked position, the bag dispenser can be configured to remove and/or receive the roll of bags 90.

The roll of bags 90 can be wound about a center axis $A_C$ such that the roll of bags 90 has a generally cylindrical shape with an outer circumferential surface 92 with first and second circular bases 94 and 96, respectively. A width $W_r$ of the roll of bags 90 can be defined as a distance between the first and second bases 94 and 96 measured along the center axis $A_C$. A radius r of the roll of bags 90 can be defined as a distance from the center axis $A_C$ to the circumferential surface along an axis that is perpendicular to the center axis $A_C$. In some embodiments, the roll of bags 90 can be formed about an inner core or tube 98, which defines a center opening 100 extending through the roll of bags 90 from the first base 94 to the second base 96 along the center axis $A_C$. In some embodiments, the roll of bags 90 can be devoid of an inner core or tube 98, but can include the center passage 100.

Referring now to FIGS. 1 and 3-5, when the arm 60 has been rotated, as shown for example in FIG. 3, to an unlocked position, the roll of bags 90 can be mounted on the bag dispenser 10 by aligning the center opening 100 of the roll of bags 90 with the pin 80 and urging the roll of bags 90 towards the distal end 84 of the pin 80 until the distal end 84 of the pin 80 is received in and passes through the center opening 100. After the roll of bags 90 is mounted on the pin 80, the weight of the roll of bags 90 forces a portion of the outer surface 92 of the roll of bags 90 to rest against the bag support portion 30 of the base member 24. The arm 60 can be rotated to the locked position so that the distal end 84 of the pin 80 engages and is retained by the bounded channel 66, which secures the roll of bags 90 within the space or area 78 between the arms 40 and 60. In exemplary embodiments, a width $W_s$ of the space or area 78 can be slightly greater than the width $W_r$ of the roll of bags 90.

As the roll of bags is unwound, the hooked portion 32 of the base member 24 can catch the interface between adjacent bags on the roll of bags 90 to separate a bag from the roll of bags 90 as the bag is pulled. The radius r (and circumference) of the roll of bags 90 can decrease as bags are unwound from the roll of bags 90. As the radius r and circumference decrease, the center axis $A_C$ (and the center opening 100) of the roll of bags 90 and the pin 80 to move towards the base member 24 due to gravity so that a portion of the outer surface 92 of the roll of bags 90 remains in contact with the bag support portion 30 of the base member 24, and the bag support portion 30 provides a friction force against the unwinding of the roll of bags 90 to provide tension on the bags as the bags are pulled from the roll of bags 90. As the pin 80 moves with the center axis $A_C$ of the roll of bags 90, the proximal and distal ends 82 and 84 of the pin 80 travel or slide within the bounded channels 46 and 66, respectively, towards the support structure 20.

Figure 6:
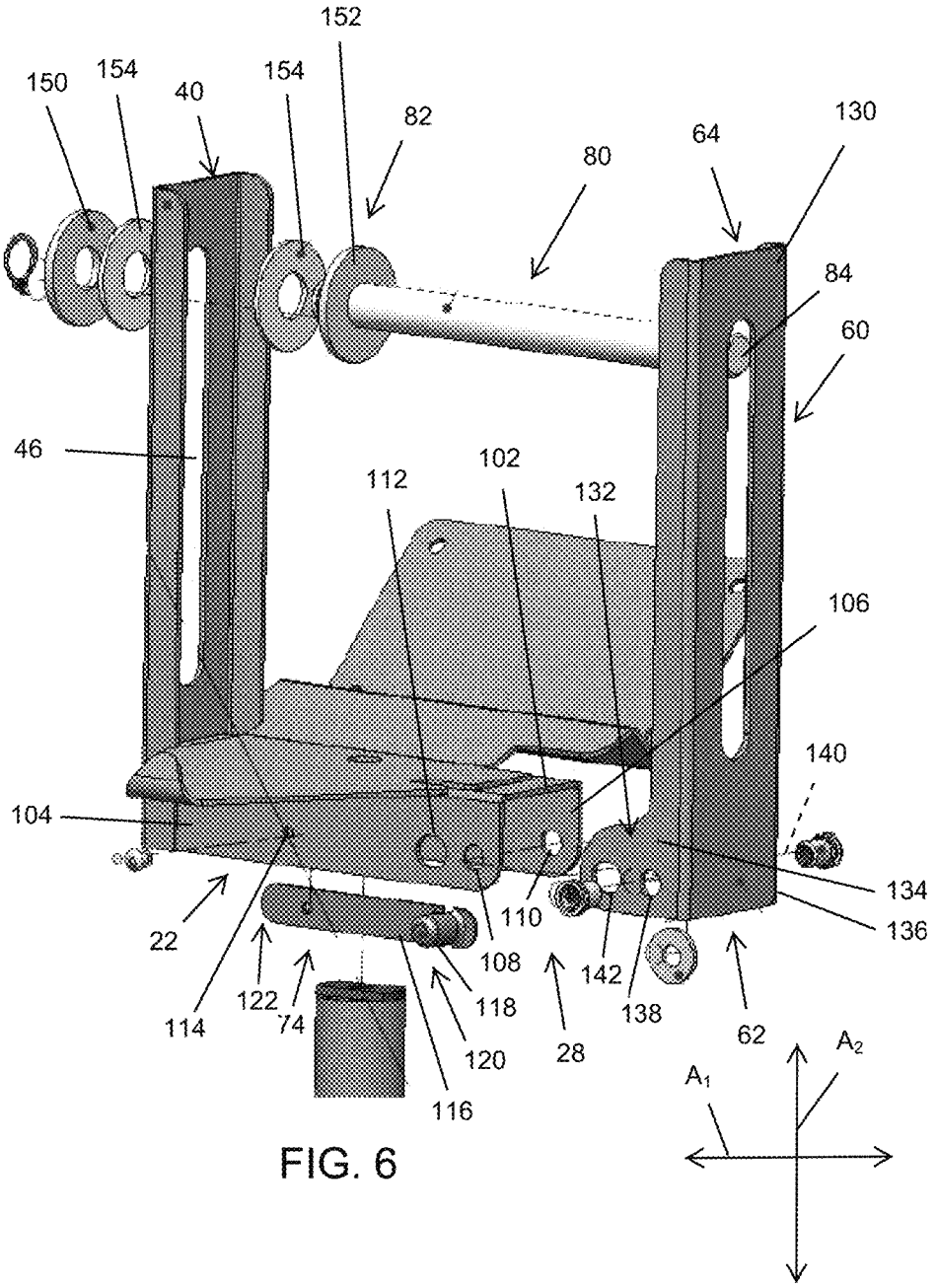
FIG. 6 illustrates a partially exploded view of an embodiment of the bag dispenser in accordance with embodiments of the present disclosure.
Figure 7:
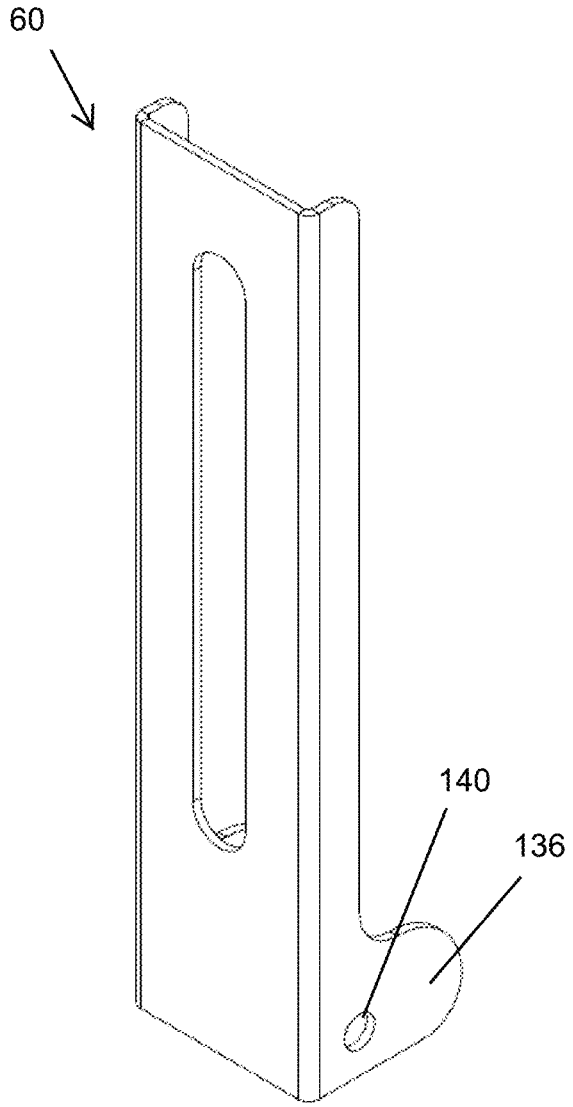
FIG. 7 is a perspective view of an arm of the bag dispenser in accordance with embodiments of the present disclosure.

FIG. 6 illustrates a partially exploded view of an embodiment of the bag dispenser 10 in accordance with embodiments of the present disclosure. FIG. 7 is a perspective view of the arm 60 of the bag dispenser in accordance with embodiments of the present disclosure. As shown in FIG. 6, an embodiment of the elongated body member 22 can have a generally U-shaped side profile including a bridge portion 102 and opposingly spaced flange portions 104 and 106 extending perpendicularly from the bridge portion 102. The second end 28 of the elongated body member 22, of the support structure 20, can include apertures or openings for creating the joint 72 (FIG. 1) between the support structure 20 and the arm 60 and for receiving the locking member 74. For example, the flange portion 104 can include an opening 108 and the flange portion 106 can include an opening 110. The openings 108 and 110 can be aligned with each other and aligned with the axis of rotation $A_R$ about which the arm 60 can rotate when the arm 60 is rotatably coupled to the support structure 20. The flange portion 104 can also include an opening 112 for receiving the locking member 74 and an opening 114 spaced away from the opening 112 that can be used to secure the locking member 74 to the elongated body member 22.

The locking member 74 can include an elongated resilient member 116 and a protrusion 118 extending perpendicularly from the elongated resilient member proximate to a distal end 120 of the elongated resilient member 116. The elongated resilient member 116 of the locking member 74 can be disposed in a space between the opposing flange portions 104 and 106 of the elongated body member 22. A proximal end 122 of the elongated resilient member can be secured to an inner surface of the flange portion 104 by a fastener that extends through the opening 114 in the flange portion 104. When the proximal end 122 of the elongated resilient member 116 is secured to the flange portion 104, the protrusion 118 disposed proximate to the distal end 120 of the elongated resilient member aligns with and extends through the opening 112 formed in the flange portion 104.

Referring now to FIGS. 6 and 7, the arm 60 can have an L-shaped side profile, where a first leg 130 of the arm 60 extends between the arm ends 62 and 64 and a second leg 132 of the arm 60 extends from the arm end 62. The second leg 132 can be formed by opposing flanged portions 134 and 136 and can include openings 138, 140, and 142 corresponding to the openings 108, 110, and 112 formed in the flange portion 104 of the elongated body member 22 such that when the flange portions 134 and 136 of the second leg 132 are flange portions 104 and 106 are secured to each other, the opening 138 aligns with the opening 108, the opening 140 aligns with the opening 110, and the opening 142 aligns with the opening 112. In exemplary embodiments, the openings 108 and 138 can receive a fastener to rotatable secure the flange portion 104 to the flange portion 134, and the openings 110 and 140 can receive a fastener to rotatable secure the flange portion 106 to the flange portion 136 to collectively create the joint 72 (FIG. 1). When the arm 60 is in the locked position, the protrusion 118 can be received by and extend through the opening 142 to secure the arm 60 in the locked position. The protrusion 118 can be depressed or deflected inwardly towards the space between the flange portions 104 and 106 to disengage the protrusion from the opening 142 and unlock the position of the arm 60 so that the arm 60 can be rotated to unlocked positions.

With reference again to FIG. 6, the proximal end 82 of the pin 80 can be secured to the arm 40 by one or more plates. For example, the proximal end 82 of the pin can include a plates 150 and 152 coupled thereto. In some embodiments, the plates 150 and 152 can formed as washers. The plates 150 and 152 can be affixed to the proximal end 82 of the pin by a weld joint or any other suitable fasteners. The plates 105 can be affixed to the proximal end 82 of the pin 80 to secure the pin 80 to the arm 40 so that the pin 80 is retained by the bounded channel 46 and so that the pin 80 is generally prevented from moving along the axis $A_1$ and is generally free to slide along the bounded channel 46 along the axis $A_2$. For example, the plates 150 and 152 can be disposed on opposite side of the arm 40. In some embodiments, (nylon) washers 154 can be disposed on the proximal end of the pin 80 between the plates 150 and 152 and the arm 40 to minimize friction. For example, the arrangement of plates 150 and 152 and washers 154, beginning at the proximal end 82 of the pin and moving towards the distal end 84 of the pin 80, includes the plate 150 followed by one of the washers 154, the arm 40, another one of the washers 154, and finally the plate 152.

Figure 8:
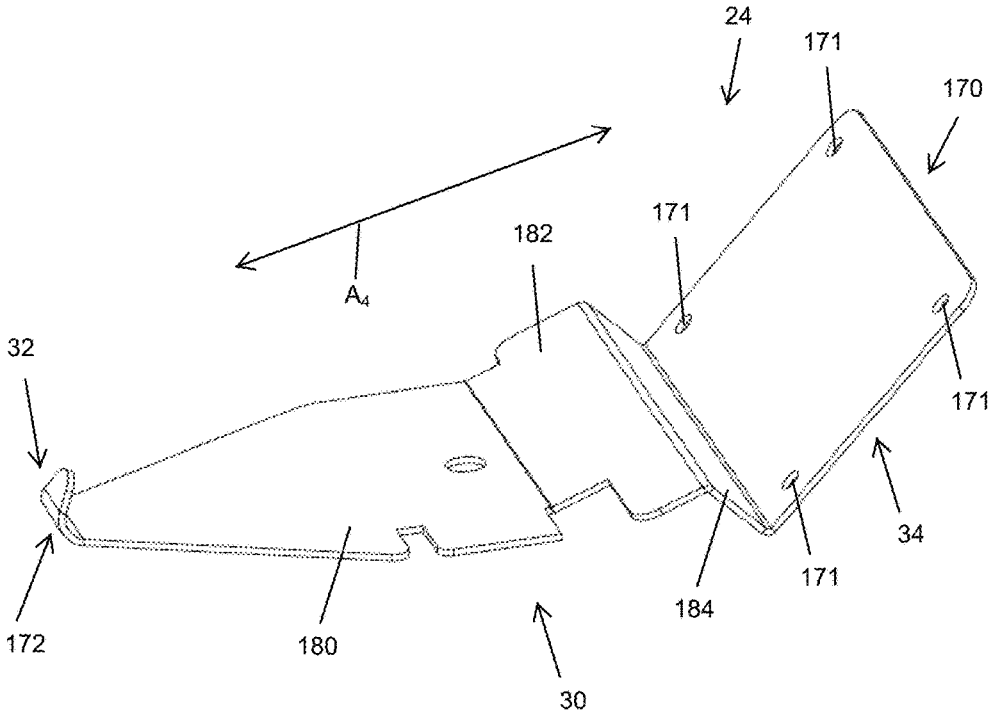
FIG. 8 illustrates a perspective view of a base member of an embodiment of the bag dispenser.
Figure 9:
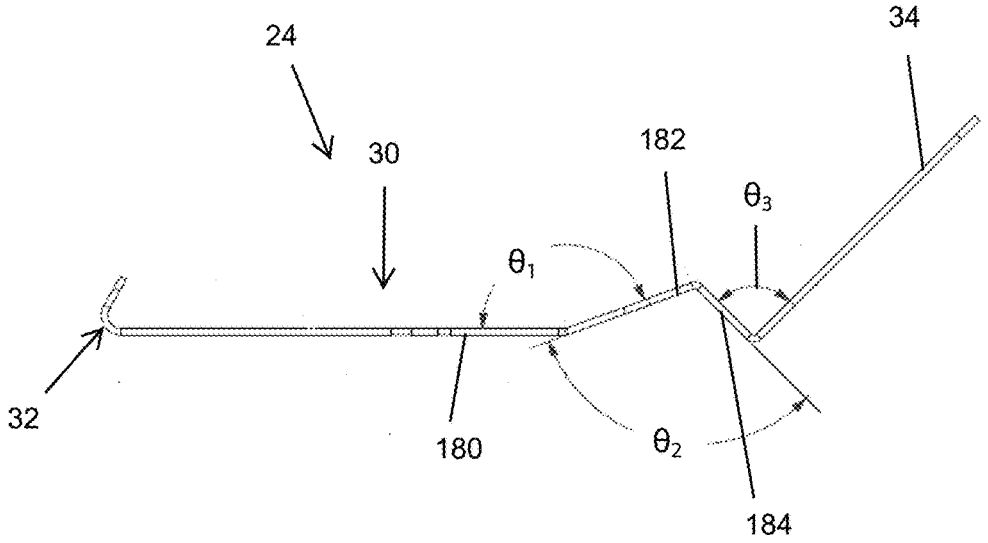
FIG. 9 illustrates a side elevation view of an embodiment of the base member shown in FIG. 8.

FIG. 8 illustrates a perspective view of an embodiment of the base member 24 of the support structure 20. FIG. 9 illustrates a side view of an embodiment of the base member 24 shown in FIG. 8. The base member 24 can include the bag support portion 30, the hooked portion 32, and the wall-mounting portion 34. A length of the base member 24 generally extends along an axis $A_4$. The wall-mounting portion 34 is generally planar and is disposed at a distal end 170 of the base member 24. The wall-mounting portion can include one or more apertures or openings 171 to facilitate mounting the bag dispenser 10 to a wall. The hooked portion 32 is a generally curved tip formed at a proximal end 172 of the base member 24. The bag supporting portion 30 is formed between the wall-mounting portion 34 and the hooked portion 32 and include several planar portions that are angled with respect to each other.

The bag support portion can include a first planar portion 180, a second planar portion 182, and a third planar portion 184. The first planar portion 180 tapers inwardly along an axis $A_4$ towards the hooked portion 32 and includes a notch 186 formed in one side to accommodate the arm 60 as it rotates between locked and unlocked positions. The second planar portion 182 has a generally rectangular surface that is disposed distally from the first planar portion 180. The rectangular surface can include a notch 188 disposed therein on the same side of the notch 186 to accommodate the arm 60 as it rotates between locked and unlocked positions.

In exemplary embodiments, the first planar portion 180 and the second planar portion 182 can be disposed at a first angle $\theta_1$ relative to one another. The third planar portion 184 can have a generally rectangular surface that is disposed distally of the second planar portion 182. In exemplary embodiments, the second planar portion 182 and the third planar portion 184 can be disposed at a second angle $\theta_2$ relative to one another. The wall mounting portion 34 can extend distally from the third planar portion 184 at a third angle $\theta_3$ relative to the third planar portion 184. The first through third angles $\theta_1$-$\theta_3$ can form a jog in the base member 24. For example, with reference to FIG. 9, the second planar portion 182 extend distally from the first planar portion 180 at an incline corresponding the to the first angle $\theta_1$, the third planar portion 184 can extend distally from the second planar portion at a decline corresponding to the second angle $\theta_2$, and the wall-mounting portion can extend distally from the third planar portion 184 at an incline corresponding to the third angle $\theta_3$.

Figure 10:
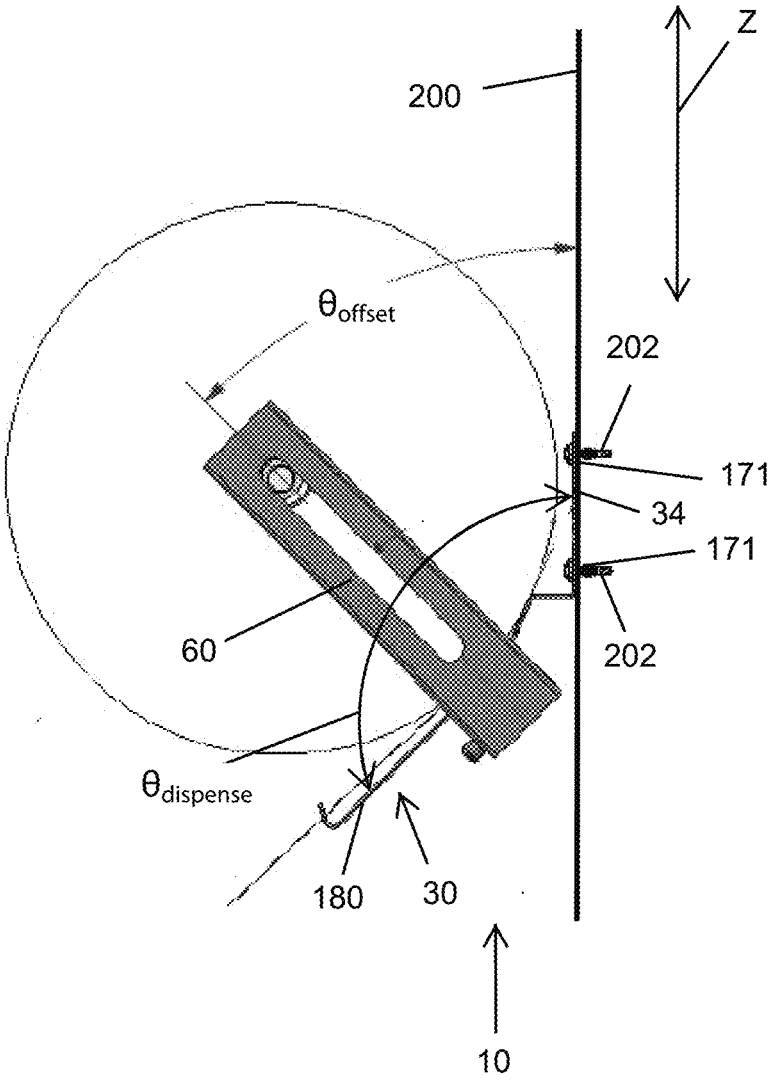
FIG. 10 illustrates a side view of an embodiment of the bag dispenser configured to be mounted to a vertical support structure.

FIG. 10 illustrates a side view of an embodiment of the bag dispenser 10 mounted to a vertical support structure 200 (e.g., a wall). As shown in FIG. 10, the wall-mounting portion 34 can be disposed flush against the structure 200. Fasteners 202 can be received by the apertures or openings 171 on the wall-mounting portion 34 and can be secured to the structure 200. In the example arrangement wall-mounting portion can extend vertically in a plane along a z-axis. The arms 40 (FIG. 1) and 60 can be offset from the z-axis by an offset angle $\theta_{offset}$ and the first planar portion 180 of the bag supporting portion 30 can extend downwardly at a dispensing angle $\theta_{dispense}$. Each of the offset angle $\theta_{offset}$ and dispensing angle $\theta_{dispense}$ can be defined based on the first through third angles $\theta_1$-$\theta_3$ (FIG. 9) of the bag support portion 30. As one non-limiting example, the offset angle $\theta_{offset}$ can be approximately forty-five degrees.

FIG. 11 is a flowchart illustrating a process 210 for installing a roll of bags on embodiments of the bag dispenser 10 as described herein with reference to FIGS. 1-10. The process begins at step 212. At step 214, the protrusion of the locking member 174 is depressed to allow the arm 60 of the bag dispenser 10 to rotate to unlocked positions. At step 216, the arm 60 is rotated to a first position in which the arm 60 is perpendicular to the arm 40. At step 218 a roll of bags is mounted on the pin 80 of the bag dispenser 10 by urging the roll of bags laterally towards the arm 40 so that the pin 80 secured to and extending from the arm 40 is received within the center opening of the roll of bags until a distal end of the pin extend outwardly from the center opening. A portion of the outer surface of the roll of bags rest upon the support structure when the roll of bags is mounted on the pin 80. At step 220, the arm 60 is rotated so that the arm 60 is parallel to and opposingly spaced from the arm 40 to position the roll of bags in the space between the arm 40 and the arm 60. The distal end of the pin 80 can be received by the arm 60 when the arm is rotated into this position. At step 222, the protrusion of the locking member can extend through the opening 112 formed in the arm 60 to lock the position and orientation of the arm 60 and to secure the roll of bags to the bag dispenser 10. The process ends at step 224.

In describing exemplary embodiments, specific terminology is used for the sake of clarity. For purposes of description, each specific term is intended to at least include all technical and functional equivalents that operate in a similar manner to accomplish a similar purpose. Additionally, in some instances where a particular exemplary embodiment includes a plurality of elements, device components or method steps, those elements, components or steps may be replaced with a single element, component or step. Likewise, a single element, component or step may be replaced with a plurality of elements, components or steps that serve the same purpose. Moreover, while exemplary embodiments have been shown and described with references to particular embodiments thereof, those of ordinary skill in the art will understand that various substitutions and alterations in form and detail may be made therein without departing from the scope of the invention. Further still, other embodiments, functions and advantages are also within the scope of the invention.

Exemplary flowcharts are provided herein for illustrative purposes and are non-limiting examples of methods. One of ordinary skill in the art will recognize that exemplary methods may include more or fewer steps than those illustrated in the exemplary flowcharts, and that the steps in the exemplary flowcharts may be performed in a different order than the order shown in the illustrative flowcharts.

The invention claimed is:

1. A bag dispenser comprising:

a support structure having an elongated body extending between a first end and a second end;

a first arm operatively coupled to and extending perpendicularly from the first end of the support structure, the first arm including a first bounded channel extending along a length of the first arm;

a pin having a proximal end and a distal end and extending through the first bounded channel, the proximal end of the pin being secured to the first arm and being configured to translate within the first bounded channel between a first opposing channel ends, the first opposing channel ends preventing removal of the pin from the first bounded channel; and a second arm operatively coupled to and extending from the second end of the support structure, the second arm including a second bounded channel extending along a length of the second arm between second opposing channel ends;

wherein the second arm is configured to rotate, via a joint, between (i) a first position in which the second arm is perpendicular to the first arm to facilitate installation of a roll of bags having a center opening through which the pin is configured to extend, and (ii) a second position in which the second arm is parallel to and opposingly spaced from the first arm, the distal end of the pin extends through the second bounded channel of the second arm when the second arm is in the second position to secure the roll of bags between the first and second arms.

2. The bag dispenser of claim 1, wherein the support structure includes a base member having a bag support portion upon which a portion of an outer surface of the roll of bags rests and a hooked portion being configured to separate individual bags in the roll of bags as the roll of bags in unrolled.

3. The bag dispenser of claim 2, wherein the pin is configured to slide within the first bounded channel towards the support structure so that a portion of the outer surface remains in contact with the base member.

4. The bag dispenser of claim 2, wherein the base member includes a wall mounting portion configured to receive fasteners for securing the base member to a vertical wall.

5. The bag dispenser of claim 4, wherein the first and second arms are disposed at an angle with respect to a vertical wall when the base member is secured to the wall.

6. The bag dispenser of claim 2, where in the support structure includes a elongated body member and the bag dispenser further comprises:

an elongated post configured to engage the elongated body member.

7. The bag dispenser of claim 6, wherein the first and second arms are disposed in parallel with respect to the elongated post when the elongated post engages the elongated body member.

8. The bag dispenser of claim 2, wherein the base member is integrally formed with the body of the support structure.

9. The bag dispenser of claim 2, wherein the base member is removably coupled to the body of the support structure.

10. The bag dispenser of claim 1, further comprising:

a locking member operatively coupled to the support structure, the locking member configured to selective lock the second arm in the second position to prevent rotation of the second.

11. The bag dispenser of claim 10, wherein the locking member comprises an elongated resilient member and a protrusion extending perpendicularly from the elongated resilient member.

12. The bag dispenser of claim 11, wherein the second arm includes an aperture that receives the protrusion to lock the second arm in the second position.

13. A bag dispenser comprising:

a support structure having an elongated body extending from a first end to a second end;

a first arm operatively coupled to and extending perpendicularly from the first end of the support structure, the first arm including a first bounded channel extending along a length of the first arm;

a second arm operatively coupled to and extending from the second end of the support structure, the second arm including a second bounded channel extending along a length of the second arm between second opposing channel ends; and a pin having a proximal end and a distal end and extending through the second bounded channel, the proximal end of the pin being secured to the first arm and being configured to translate within the first bounded channel between the first opposing channel ends, the distal end being received by the second bounded channel and configured to translate within the second bounded channel between the second opposing channel ends, wherein the first and second opposing channel ends prevent removal of the pin from the first bounded channel and the second bound channel.

14. The bag dispenser of claim 13, wherein the second arm is parallel to and opposingly spaced from the first arm.

15. The bag dispenser of claim 14, wherein the second arm is configured to rotate to be perpendicular to the first arm to disengage the distal end of the pin from the second bounded channel.

16. The bag dispenser of claim 13, wherein the support structure includes at least two mounting portions to facilitate mounting of the support structure to a wall or a post.

* * * * *